US005211557A

United States Patent [19]

Tokitsu

[11] Patent Number: 5,211,557

[45] Date of Patent: May 18, 1993

[54] HEATING FURNACE

[75] Inventor: Tetsuya Tokitsu, Takarazuka, Japan

[73] Assignee: Taikisha Ltd., Tokyo, Japan

[21] Appl. No.: 842,008

[22] Filed: Feb. 25, 1992

[30] Foreign Application Priority Data

Oct. 3, 1991 [JP] Japan ..... 3-256087

[51] Int. Cl.[5] ..... F27D 3/00

[52] U.S. Cl. ..... 432/243; 432/173; 432/235

[58] Field of Search ..... 432/122, 123, 173, 233, 432/234, 235, 243

[56] References Cited

U.S. PATENT DOCUMENTS

| | | | |
|---|---|---|---|
| 3,434,702 | 3/1969 | Krause | 432/243 |
| 3,567,200 | 3/1971 | Knaak et al. | 432/243 |
| 3,749,550 | 7/1973 | Snydam | 432/243 |

OTHER PUBLICATIONS

"Industrial Furnace Handbook"; edited by Japan Industrial Furnace Association; Tokyo Center-Co., Ltd.

*Primary Examiner*—Henry C. Yuen

*Attorney, Agent, or Firm*—Webb, Burden, Ziesenheim & Webb

[57] ABSTRACT

A heating furnace for e.g. a hot rolling process of any object is disclosed. The furnace has a heat-resistant conveyer device for conveying a treatment object in a high-temperature atmosphere inside the furnace. The conveyer device includes an elongate cooling chamber, a rotary-member guiding passage, an endless rotary member, a drive unit and a roller. The elongate elongate cooling chamber is disposed along a direction of conveying the object inside the furnace and allowing flow of a cooling medium inside the chamber. The rotary-member guiding passage is constructed as a gutter-like recess formed along an entire length of the elongate cooling chamber. The endless rotary member includes a plurality of receivers interconnected with each other in the form of a loop. Each receiver has an object-receiving end thereof exposed from the guiding passage and the opposite end thereof disposed inside the guiding passage and the rotary member is driven by the drive unit to convey the object. The roller is rotatable to guide movement of the endless rotary member as the rotary member receives a load of the object applied onto the endless rotary member inside the rotary-member guiding passage.

4 Claims, 5 Drawing Sheets

HEATING FURNACE

BACKGROUND OF THE INVENTION

1. Field of the Invention

The present invention relates to a heating furnace of various types, such as a furnace employed in a hot rolling process in manufacturing steel, a reheating furnace or a hardening furnace employed for manufacturing a seamless steel pipe and a heating or heat-treating furnace used in manufacturing a copper alloy. The invention relates more particularly to a heating furnace in which an object of treatment is conveyed by means of a conveyer means within a hot temperature atmosphere present inside the furnace.

2. DESCRIPTION OF THE RELATED ART

A conventional heating furnace of the above type having the conveyer means for conveying the object within the hot temperature atmosphere inside the furnace, for use in e.g. a hot rolling process of steel production is shown in FIG. 7. With this furnace, objects W such as steel pieces are pushed into the furnace 100 one after another by means of a pusher 110 provided adjacent the charging side of the furnace 100. As the objects W are pushed by the pusher, the objects W come into slide contact with each other and are conveyed in this condition on a water-cooling slider pipe 120 to the extracting side of the furnace.

In recent years, a new type of furnace has been developed. This new furnace, as shown in FIG. 8, has a plurality of movable beams arranged along the object conveying direction inside the furnace 100 and these beams repeated effect a series of motions along a rectangular path in a direction of arrow Z consisting of an upward movement, a forward movement, a downward movement and a rearward movement. With the upward movement, the beam lifts up the object on a fixed beam. Next, with the forward movement, the beam forwardly moves the object W. And, with the subsequent downward movement of the beam, the object W is placed onto a further fixed beam disposed more downstream than the aforesaid fixed beam. After completion of this operation, the beam moves rearward to become ready for a next operation. This type of furnace is commonly referred to as a walking beam type furnace and has already been put into practice in some applications such as a heating furnace used in a hot rolling process of steel production and a heating furnace used for other types of processes such as production of a seamless steel pipe and a copper alloy treatment process.

However, with the first-described pusher type furnace, during the conveying operation effected inside the furnace under the severe condition of high temperature atmosphere (e.g. as high as 1,300 degrees in Celsius in the case of hot rolling of steel pieces), there often occurs abrasive damage on the objects W through their sliding contact with the water cooling slider pipe 120. This results in deterioration in the product quality and yields.

Further, in e.g. steel manufacturing process, the objects often weight over several hundreds of tons. Then, in order to forcibly push such enormous mass into the furnace against large friction between the objects W and the slider pipe 120, the pusher 110 must exert an extremely large pushing force. Accordingly, the system suffers high running costs for its conveyer unit and the application of such large pushing force tends to aggravate the abrasive damage on the objects.

Moreover, in case the furnace has a significant length, the length of the object group increases accordingly. Then, the greater this length of object group is, the greater pushing force the pusher must exert. Further, when the objects having such significant length are pushed in the forcible manner, there often occur the trouble that the pushing force raises some of the objects of the group relative to the rest or that the force causes overlapping of the objects. In either case, the entire conveying operation can be disabled. In this respect, the scale or the length of the furnace is restricted.

For instance, in the case of the pusher type furnace, in order to avoid the above-described troubles, the following practice is usually observed:

thickness of steel piece × (200 through 250) > the maximum length of the objects (i.e. steel pieces) feedable by the pusher Accordingly, when the steel piece has a thickness of 100 mm, it is unfeasible to extend the length of the furnace beyond 25 m.

On the other hand, in the case of the walking beam type furnace, while this construction decreases the occurrence of the abrasive damage on the objects W in comparison with the above-described pusher type, the construction suffers the problem of complexity and high installment and running costs. Specifically, the plurality of movable beams which effect the rather complicated rectangular movement (along the arrow Z in the drawing) must be installed inside the furnace. Further, in order to endure the high temperature atmosphere inside the furnace often exceeding 1,000 degrees in Celsius, each of the fixed beams and the movable beams must be equipped with its cooling means. Thus, the system becomes complicated and such complicated system inevitably suffers high installment and running-maintenance costs.

Also, in order to lift up and then to forwardly move the object W, the movable beam must be supplied with a large power. This fact further adds to the increase of the running costs.

The primary object of the present invention is to solve the above-described problems of the convention through improvement of the conveyer means of the furnace, which improvement effectively overcomes the problems of the conventional pusher type and walking beam type furnaces while maintaining good heat-resistance against the high temperature atmosphere inside the furnace.

SUMMARY OF THE INVENTION

To fulfill the above-described object, according to the present invention, a heating furnace comprising:

a heat-resistant conveyer device for conveying a treatment object in a high-temperature atmosphere inside the furnace, the conveyer device having an elongate cooling chamber, a rotary-member guiding passage, an endless rotary member, a drive means and a roller;

said elongate cooling chamber being disposed along a direction of conveying the object inside the furnace and allowing flow of a cooling medium inside the chamber;

said rotary-member guiding passage being constructed as a gutter-like recess formed along an entire length of said elongate cooling chamber;

said endless rotary member including a plurality of receivers interconnected with each other in the form of a loop, each said receiver having an object-receiving end thereof exposed from said rotary-member guiding passage and the opposite end thereof disposed inside said guiding passage, said rotary member being driven by said drive means to convey the object; and said roller being rotatable to guide movement of said endless rotary member as said rotary member receives a load of the object applied onto said endless rotary member inside said rotary-member guiding passage.

Functions and effects of the furnace having the above features of the invention will be described next.

According to the above-described construction, the objects are supported on the receivers of the endless rotary member, and in this condition, the endless rotary member having a plurality of receivers interconnected in the form of a loop is driven by the drive means to rotate to convey the object inside the furnace. More particularly, the rotary member is driven via the rollers each of which supports the load of the object placed on the receiver. This arrangement is advantageous for lessening the driving power required for conveying the object and also for stabilizing and smoothing the conveying operation.

Further, since the elongate cooling chamber is disposed along the object-conveying direction and the gutter-like recess formed along the entire length of the cooling chamber functions as the rotary-member guiding passage for guiding the movement of the endless rotary member, disadvantageous transfer of heat from the hot-temperature atmosphere inside the furnace to the guiding passage can be effectively restricted thereby to protect the rotary member and the roller against the hot-temperature atmosphere.

Further, according to the above construction of the invention, the objects are conveyed inside the furnace with the objects being supported on the respective receivers of the endless rotary member. Therefore, in comparison with the conventional pusher type furnace where the objects are conveyed as being slided on a water-cooling slider pipe or the conventional walking beam type furnace where each object is conveyed from the movable beam to the fixed beam, the construction of the invention can effectively prevent the occurrence of e.g. abrasive damage on the object. Consequently, the invention's construction can achieve the improvement of product quality and yields.

Further, although the object are conveyed in a manner similar to a conventional conveyer system, the conveyer device, in the construction of the present invention, is effectively protected against the heat as the rotary-member (i.e. conveyer means) guiding passage is surrounded by the cooling chamber. So that, this conveyer device has good heat resistance and durability.

Because of the use of the roller guiding arrangement, the power for driving the endless rotary member has been significantly reduced. Therefore, as compared with the pusher type which requires the pusher to exert an enormous amount of pushing force to overcome the frictional resistance between the objects and the water-cooling slider pipe and the walking beam type in which many movable beams require a great amount of power to lift up and to forwardly move the objects, the construction of the present invention can achieve substantive reduction in the power requirement for conveying the object, so that the entire system can run at much lower costs.

Because of the use of the conveyer type arrangement, the cooling means can be constructed very simply as the cooling chamber fixedly disposed along the object-conveying direction. Thus, the entire construction is very simple. This is advantageous for further reduction in the installment, running and maintenance costs. Also, unlike the pusher type construction, the construction of the invention is free from the trouble that the pushed objects become raised or overlapped relative to each other. Therefore, the invention's construction readily allows enlargement of the capacity or the length of the entire heating furnace.

In embodying the present invention, it is conceivable to provide a cover element for covering a receiver-projecting opening of a receiver portion in the rotary-member guiding passage.

With this additional arrangement, it becomes possible to restrict entrance of heat and/or foreign matter into the guiding passage through the opening. Consequently, the construction can achieve the above-described effects in more stable and reliable manner.

Further, and other objects, features and effects of the invention will become more apparent from the following more detailed description of the embodiments of the invention with reference to the accompanying drawings.

DESCRIPTION OF THE PREFERRED EMBODIMENTS

Preferred embodiments of a heating furnace relating to the present invention will now be described in details with reference to the accompanying drawings.

Figure 1:
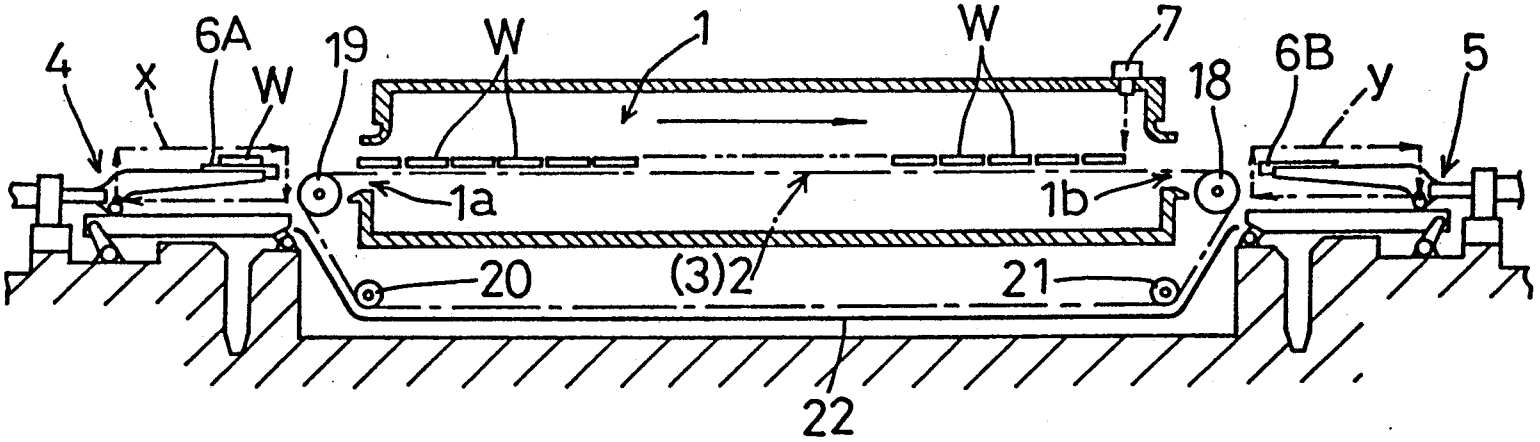
FIG. 1 is a vertical section of a heating furnace of the invention.
Figure 2:
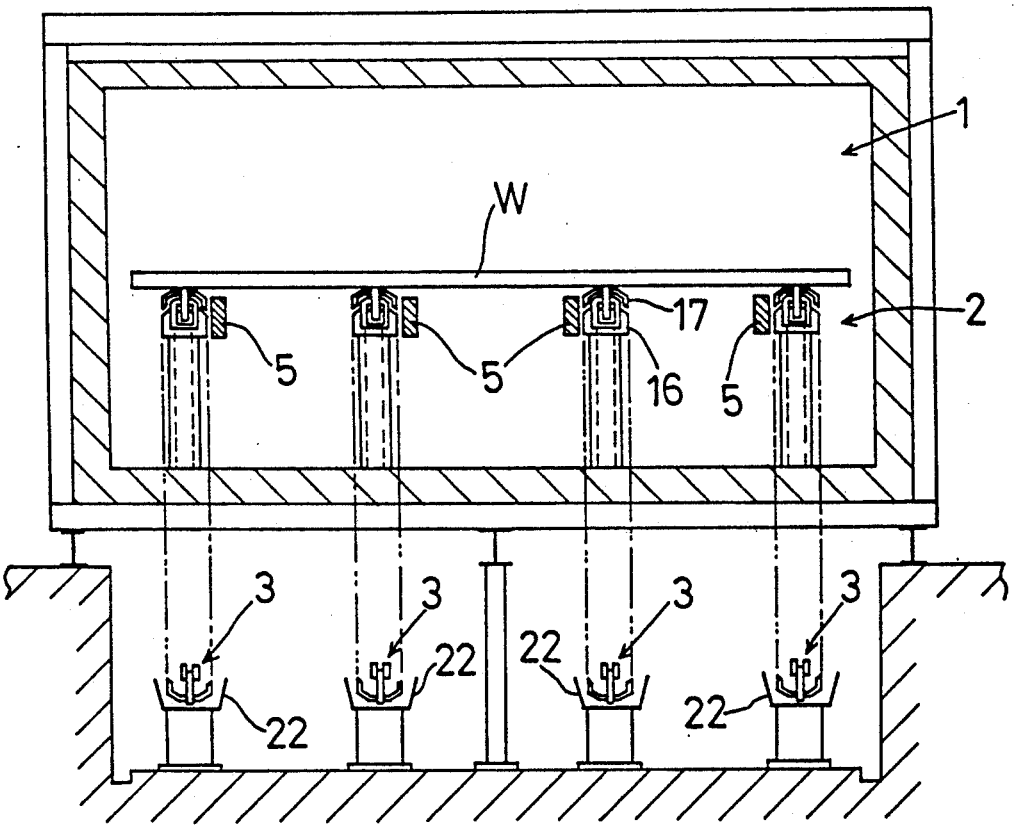
FIG. 2 is a section of the furnace.

FIGS. 1 and 2 show a heating furnace 1 for heat-treating steel pieces W as treatment objects at a hot rolling process of steel production. This furnace 1 is equipped with a conveyer device 2 for conveying the steel pieces W one after another with a predetermined space therebetween from a charge opening 1*a* to an extraction opening 1*b* of the furnace 1.

The conveyer device 2 includes a plurality of endless rotary members 3 arranged side by side along a width of the furnace, with each rotary member 3 being rotatable from an interior of the furnace to an exterior downward region of the furnace. In operation, the steel piece W is placed astride the endless rotary member 3, and this rotary member 3 is driven to rotate for conveying the steel piece W thereon.

A numeral 4 denotes a charger movable along a rectangular path (denoted with an arrow 'x') on the charging side of the furnace 1 so as to first receive the steel piece W from a charger-line table 6A and then to place this piece W onto the endless rotary member 3. A numeral 5 denotes an extractor movable along a rectangular path (denoted with a further arrow 'y') on the extracting side of the furnace 1 so as to first receive the steel piece W from the rotary member 3 and then to place this piece W onto a rolling-line table 6B.

A numeral 7 denotes a photocell for detecting a leading edge of the steel piece W conveyed to the extracting position. As this photocell 7 detects the leading edge of the piece W, the rotation drive of the endless rotary member 3 is stopped. Then, based on an extracting instruction from the rolling-line table 6B, the extractor 5 starts its extracting operation. Upon completion of this extracting operation of the steel piece by the extractor 5, the drive rotation of the endless rotary member 3 is resumed and the rotary member is rotated until the photocell 7 detects a leading edge of a next steel piece W.

Figure 3:
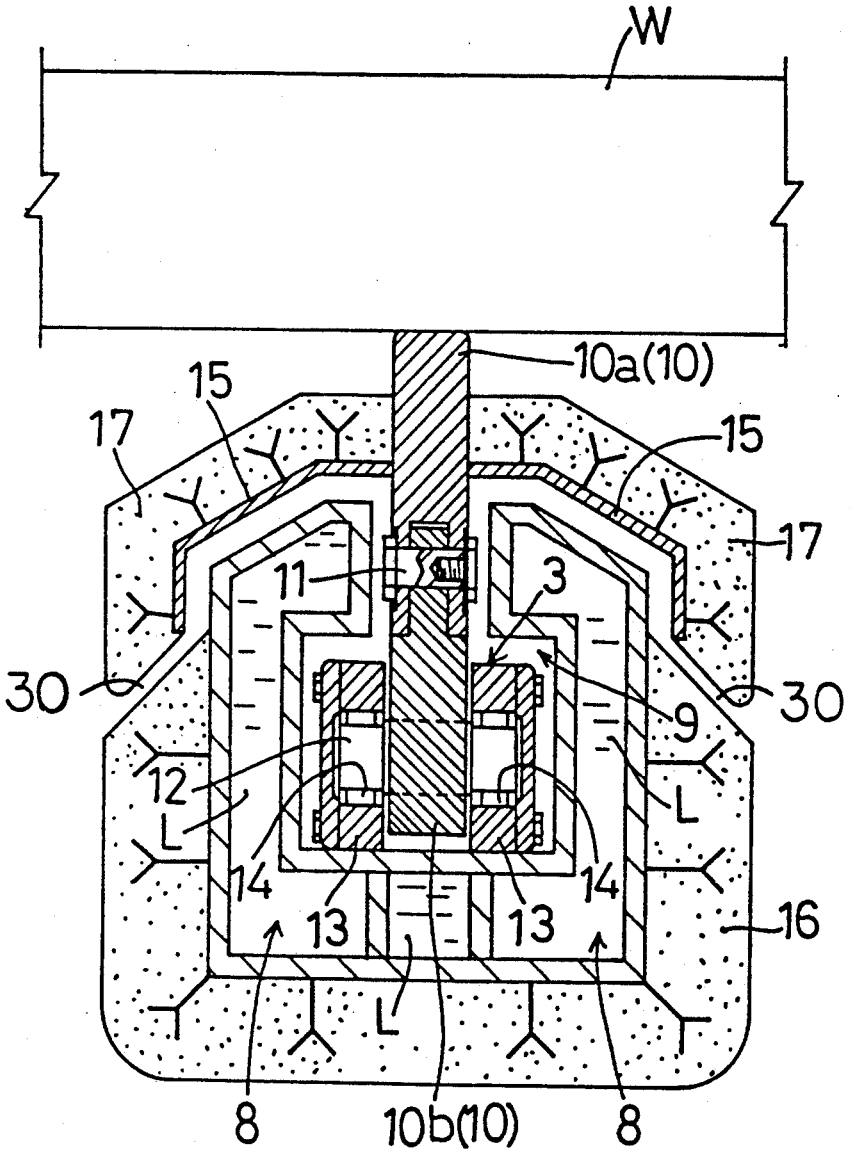
FIG. 3 is an enlarged section showing a cooling chamber and an endless rotary member of the furnace.
Figure 4:
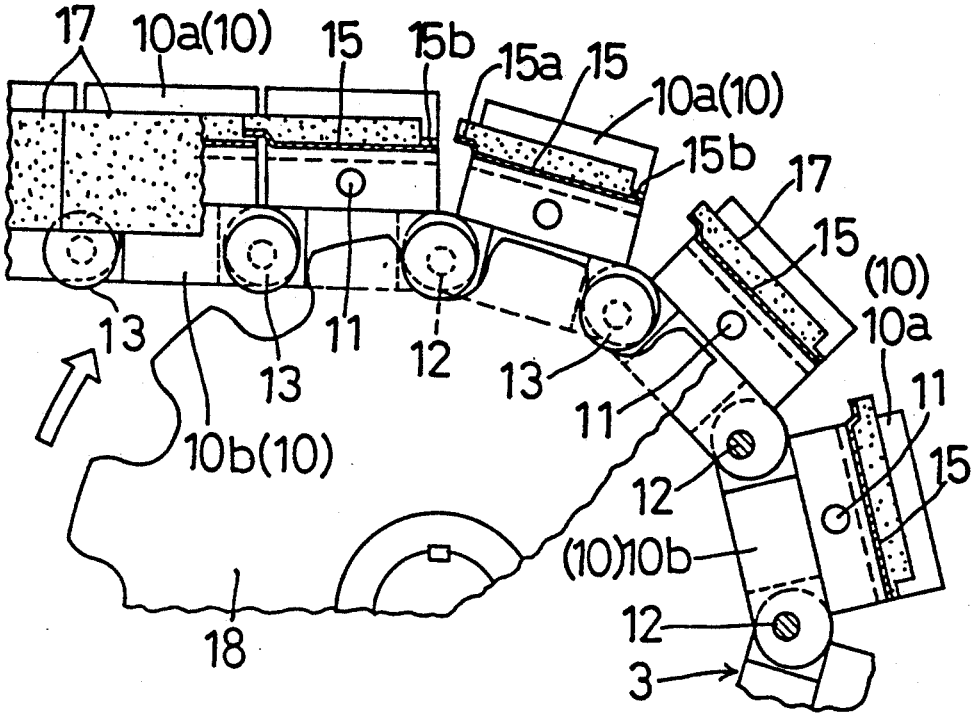
FIG. 4 is an enlarged side view of the endless rotary member.
Figure 5:
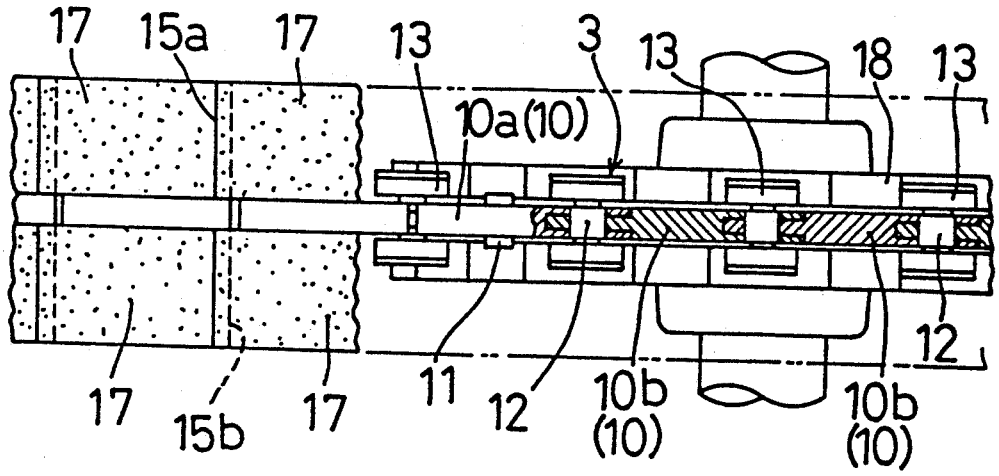
FIG. 5 is an enlarged plane view of the endless rotary member.

Inside the furnace 1, there are provided a plurality of arrays of cooling chambers 8 extending in the object-conveying direction along the entire length of the furnace 1. In each cooling chamber 8, cooling water L is caused to flow as illustrated in FIG. 3.

Further, each cooling chamber 8 has a gutter-like elongate recess 9 extending along the entire length of the chamber 8, and this gutter-like elongate recess 9 functions as a rotary-member guiding passage for guiding a portion of the endless rotary member 3 inside the furnace 1.

The detailed construction of the endless rotary member 3 is shown in FIGS. 1 through 5. As shown, the rotary member 3 includes a plurality of receiver portions 10*a* (formed of heat-resistant steel). Each receiver portion 10*a* has an object-receiving end thereof exposed from the rotary-member guiding passage 9 and the opposite terminal end thereof disposed inside the guiding passage 9. There is further provided a cart portion 10*b* which is entirely positioned inside the guiding passage 9. Then, these receiver portion 10*a* and the cart portion 10*b* are connected with each other via a pin 11 to form together an object receiver 10.

Further, the cart portions 10*b* of the receivers 10 adjacent each other along the guiding passage 9 are pivotably and flexibly connected with each other via a shaft 12; and a plurality of the receivers 10 are connected with each other in the form of a loop thereby to form the endless rotary member 3.

On opposed ends of the shaft 12, there are mounted rollers 13 through bearings 14. These rollers 13 receive the load of the steel piece W applied onto the receiver 10 and roll in this condition inside the guiding passage 9 to guide the object-conveying horizontal movement of the endless rotary member 3.

According to the above construction, the steel piece W is not lifted up but is conveyed in the horizontal direction by the rotary member 3; and this horizontal conveying operation of the rotary member 3 is guided by the rollers 13. Therefore, this construction can reduced the power required for driving the rotary member 3 and can also effect the conveying operation of the steel piece in a stable and smooth manner. Further, the inside of the gutter-like elongate recess formed in the cooling chamber 8 in which the cooling water L flows is utilized as the guiding passage 9 for the rotary member 3, so that the periphery of the rotary-member guiding passage 9 is surrounded by the cooling chamber 8. Therefore, transfer of heat of the hot-temperature atmosphere into the guiding passage 9 can be effectively prevented and consequently the construction provides the endless rotary member 3 and the rollers 13 with improved protection against the heat.

The cooling chamber 8 has a C-shaped cross section and has an upper opening through which the receiver projects from the guiding passage 9. The upper opening has a width shorter than the inner portion of the guiding passage 9 where the rollers 13 are disposed. This arrangement further adds to the heat protection effect described above.

Further, the receiver portion 10*a* of the receiver 10 is provided with an umbrella-like cover 15 for covering an upper region of the cooling chamber 8 so as to cover the upper opening of the guiding passage 9. And, a pair of covers 15 positioned adjacent each other along the length of the guiding passage 9 are gaplessly disposed with opposed ends 15*a*, 15*b* of these covers 15 are overlapped with each other. This arrangement further prevents the intrusion of the heat and any foreign matter through the opening into the guiding passage 9. Consequently, the arrangement further improves the heat protection effect for the endless rotary member 3 and the rollers 13 and the stability and smoothness of the object conveying operation.

A reference numeral 16 denotes a heat insulating material affixed to an outer side of the cooling chamber 8. A reference numeral 17 denotes also a heat insulating material affixed to an outer side of the cover 15. The insulating materials 16, 17 cooperate to define a gap 30, extending outwardly and downwardly from cooling chamber 8.

A numeral 18 denotes a drive sprocket engageable with the rollers 13 to drive these rollers thus rotating the endless rotary member 3. This drive sprocket 18 is disposed on the extracting side of the furnace so that the rotary member 3 on which the load of the steel piece is applied is driven by being pulled.

A numeral 19 denotes a free sprocket engageable with the rollers 13 to be freely rotated therewith. This free sprocket is disposed on the charging side of the furnace. Numerals 20 and 21 similarly denote lower free sprockets engageable with the rollers 13 to be freely rotated therewith.

In order to comply with needs for reverse feeding or an oscillating movement of the steel piece W, the drive construction for the conveyer device is rendered switchable between a normal conveying mode where the drive sprocket 18 is forwardly rotated while the free sprocket 19 is freely rotated and a reverse conveying mode where the drive sprocket 18 is reversely driven with reverse free rotation of the free sprocket 19.

A reference numeral 22 denotes a guiding trough for guiding a further portion of the endless rotary member 3 positioned downwardly and outside of the furnace.

Some other embodiments of the invention will be specifically described next.

Figure 6:
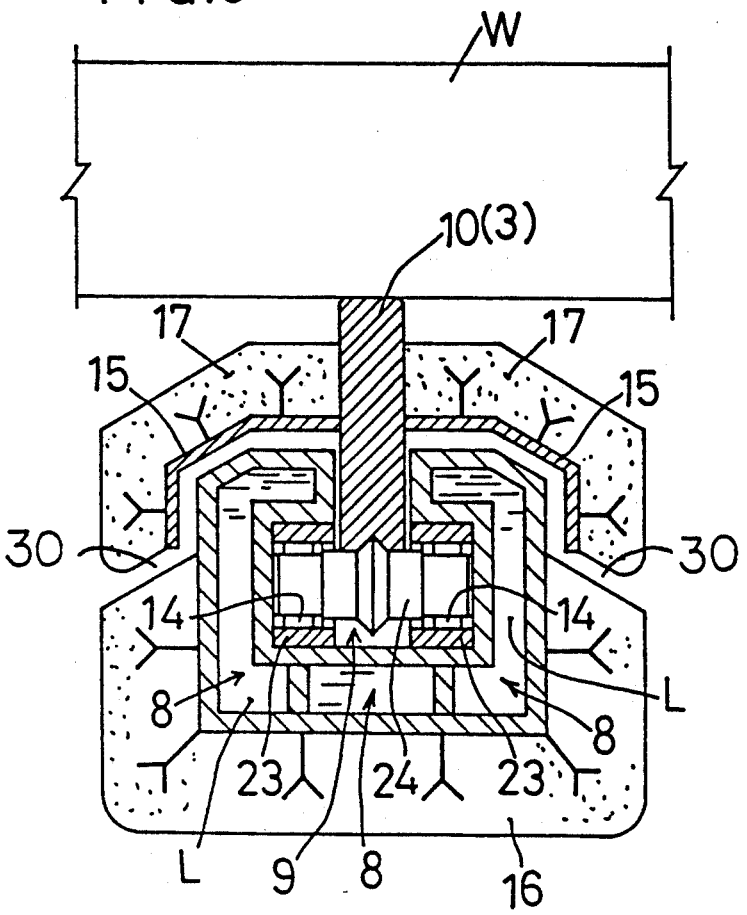
FIG. 6 is an enlarged section showing a cooling chamber and an endless rotary member of a further relating to a further embodiment of the invention.
Figure 7:
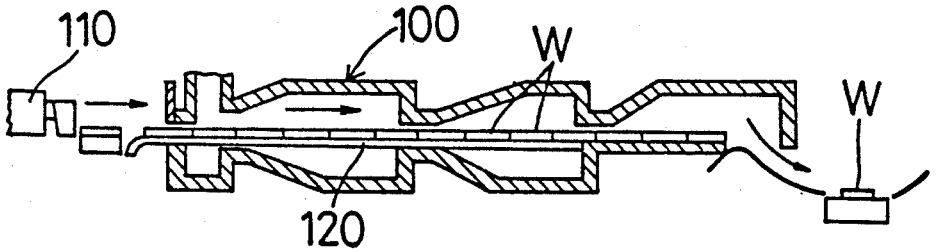
FIG.7 (PRIOR ART)
FIG. 7 is a vertical section showing a conventional furnace.
Figure 8:
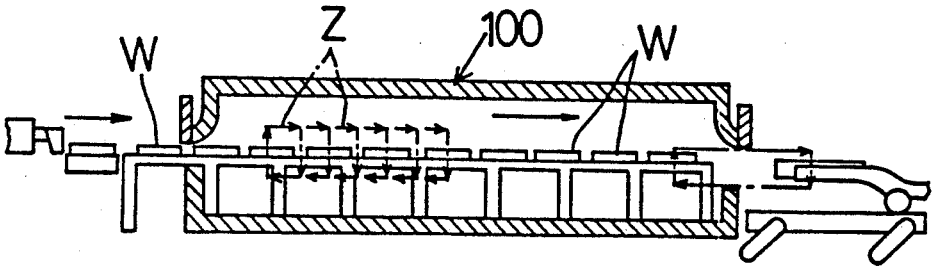
FIG.8 (PRIOR ART)
FIG. 8 is a vertical section showing a further conventional furnace.

In a further embodiment shown in FIG. 6, elements 23 corresponding to the rollers 13 in the foregoing embodiment are rotatable disposed inside the rotary-member guiding passage 9 and these elements 23 are unmovable in the object conveying direction. Also, a member 24 corresponding to the shaft 12 of the foregoing embodiment is provided. This construction too can effect the object conveying operation in a similar manner and performance to the construction of the previous embodiment.

The cooling medium to flow within the cooling chamber 8 is not limited to the water used in the previous embodiment, but may be any other liquid, gas or gas-liquid mixture fluid.

The cooling chamber 8 can consist of a plurality of sections divided along the furnace length or in the cross section. Also, various alternate constructions can be employed for introducing and withdrawing the cooling medium to and from the cooling chamber 8.

The specific configuration and construction of the object receiver 10 and the interconnecting construction between adjacent receivers 10 can be modified in various ways.

The present invention is not limited to the heating furnace for treating steel pieces, but may be embodied as any other furnace for treating various kinds of objects.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A heating furnace comprising:

a heat-resistant conveyer device for conveying a treatment object in a high-temperature atmosphere inside the furnace, the conveyer device having an elongate cooling chamber, a rotary-member guiding passage, an endless rotary member, a drive means and a roller;

said elongate cooling chamber being disposed along a direction of conveying the object inside the furnace and allowing flow of a cooling medium inside the chamber;

said rotary-member guiding passage being constructed as a gutter-like recess formed along an entire length of said elongate cooling chamber, said rotary-member guiding passage being substantially surrounded by said cooling chamber;

said endless rotary member including a plurality of receivers interconnected with each other in the form of a loop, said rotary member being driven by said drive means to convey the object;

said roller being rotatable to guide movement of said endless rotary member as said rotary member receives a load of the object applied onto said endless rotary member inside said rotary-member guiding passage;

said receiver including a receiver portion formed of heat-resistant material and having an object-receiving end projected from said rotary-member guiding passage and the opposite end disposed inside said guiding passage and a cart portion which is entirely positioned inside said guiding passage;

said receiver including a cover element closely attached to said receiver portion for covering a receiver-projecting opening in said rotary-member guiding passage, said cover element including a first heat insulating material affixed to an outer side of said cover element; and said cooling chamber including a second heat insulating material affixed to a portion of said cooling chamber outwardly and downwardly, said first heat insulating material and said second heat insulating material defining a gap of constant width therebetween, said gap extending outwardly and downwardly from said cooling chamber.

2. A heating furnace as defined in claim 1, wherein said receiver is formed by interconnecting said receiver portions and said cart portions via pins.

3. A heating furnace as defined in claim 1, further comprising:

a drive sprocket disposed on an extracting side of the furnace and engageable with said roller to drive this roller thus rotating said endless rotary member; and a free sprocket disposed on a charging side of the furnace and engageable with said roller to be freely rotated therewith.

4. A heating furnace as defined in claim 1, wherein said roller includes a shaft member which is rotatably disposed within said guiding passage, with said roller being unmovable in said object conveying direction, so that said shaft member rotates to guide said rotary member receiving the load of the object inside said guiding passage.

* * * * *